United States Patent [19]

Foessl

[11] 4,038,833

[45] Aug. 2, 1977

[54] DETACHABLE REFRIGERATION SYSTEM FOR CONTAINERS

[76] Inventor: John K. Foessl, 40 de Gaspesie, Candiac, Quebec, Canada

[21] Appl. No.: 624,445

[22] Filed: Oct. 21, 1975

[30] Foreign Application Priority Data

Sept. 16, 1975 Canada ..... 235730

[51] Int. Cl.[2] ..... F25B 41/04

[52] U.S. Cl. ..... 62/223; 62/297; 62/388; 62/514 R; 239/587

[58] Field of Search ..... 62/514 R, 239, 298, 62/384, 388, 10, 35, 223, 449, 297; 239/2 S, 587, 8

[56] References Cited

U.S. PATENT DOCUMENTS

| | | | |
|---|---|---|---|
| 2,024,599 | 12/1935 | Quinn | 62/384 |
| 3,109,296 | 11/1963 | Williamson et al. | 62/514 R X |
| 3,316,726 | 5/1967 | Pauliukonis | 62/514 R X |
| 3,611,743 | 10/1971 | Manganaro | 62/297 X |
| 3,675,439 | 7/1972 | Maurer | 62/514 R X |
| 3,684,179 | 8/1972 | Fischer et al. | 239/587 X |
| 3,693,371 | 9/1972 | Clark | 62/514 R X |
| 3,754,407 | 8/1973 | Tyree, Jr. | 62/514 R X |

*Primary Examiner*—Ronald C. Capossela
*Attorney, Agent, or Firm*—Larson, Taylor and Hinds

[57] ABSTRACT

A self-contained detachable refrigeration unit is disclosed for use in a cargo-carrying container having at least one porthole therein. Refrigeration units are well known for keeping cargos at low temperatures. In many cases such units rely on outside power. Alternatively, they include an internal combustion engine which is noisy and in turn produces a disturbance in the location of the container. The present unit is completely self-contained and overcomes the problems of the prior art. It provides an assembly having a detachable means for mounting on the container adjacent the porthole, an insulated tank supported within the frame assembly, the tank adapted to contain liquid carbon dioxide. The assembly also includes a control panel with a temperature selective control means for controlling the flow of liquid carbon dioxide to the container. A porthole closure assembly is connected to the frame assembly by a flexible connector. The porthole closure assembly fits within and about the porthole of the container and provides a venting means for the container, together with a temperature sensing device and a discharge nozzle to direct liquid carbon dioxide into the container. The flexible connector has a vent line from the venting means in the porthole closure and this vent line includes a liquid carbon dioxide line, a temperature transmission line and a control line between a valve means to control the flow of liquid carbon dioxide into the container.

8 Claims, 4 Drawing Figures

DETACHABLE REFRIGERATION SYSTEM FOR CONTAINERS

This invention relates to a refrigeration system for a cargo carrying container. More particularly, the invention relates to a self-contained carbon dioxide refrigeration unit for detachably mounting on a cargo carrying container.

By the term "container" is meant any type, either standard or non-standard used for carrying cargo and can include a truck body or rail car. Most containers used with refrigeration systems are insulated.

The use of cargo carrying containers has now become extensive in the transportation of food products. In many cases the type of product shipped requires refrigeration; thus the inside of the container must be maintained at a controlled temperature. The containers may be transported by rail, truck, ship, barge, or may remain in a storage yard for a period of time between shipments. In the majority of cases the containers have no self-contained refrigeration equipment, and are designed to connect with a centralized refrigeration system. Such systems circulate chilled air through ducts which have connections to openings in a container referred to as portholes. Some containers have self-contained refrigeration systems. Many types of self-contained cooling devices have been conceived and used in the past. Initially solid carbon dioxide, known as dry ice, was placed in trays within the container. This system, however, had a number of disadvantages, one being that the moisture and water vapor in the container formed a layer of ice that surrounded the solid carbon dioxide and acted as an insulator. Thus, the temperature in the container could not be lowered far below the freezing point of the water. Furthermore, this system lacked any means of temperature control. Mechanical refrigeration devices have been used but are generally found undesirable. These systems have a power source which is generally an internal combustion engine. Combustion engines produce a considerable amount of noise and thus cause a disturbance especially when the container is in a storage yard. Furthermore, mechanical units are expensive and known to have a high incidence of failure owing to their complexity. Cryogenic refrigeration systems are commonly used on containers today. These systems include an insulated tank properly vented, capable of containing liquid nitrogen or liquid air at temperatures of below −300° C. Inherent in these cryogenic systems is a risk of liquid air or liquid nitrogen spills which can cause serious damage not only to containers and the foodstuffs therein, but also to any exterior surfaces that are touched by the extremely cold liquids.

The present invention provides a compact refrigeration unit which may easily be mounted at one end of a cargo carrying container. The refrigeration unit allows cooling to be maintained in a container after it has been disconnected from a centralized refrigeration system. The unit has a porthole closure assembly which fits into a porthole of a container and has a temperature sensing device together with a discharge nozzle attached to the porthole closure assembly. A pressurized insulated tank supplies liquid carbon dioxide through a flexible connector to the discharge nozzle. A control system activated by the temperature sensing device monitors the flow of liquid carbon dioxide to the discharge nozzle so that the temperature within the container remains at the desired level.

Liquid carbon dioxide is maintained at a temperature of between −29° to −18° C which corresponds to a working pressure between 215/305 PSIA and thus does not pose the hazardous problems of cryogenic liquids at −300° C. Furthermore, the system works by allowing the liquid carbon dioxide to be sprayed from the discharge nozzle into the container. The liquid carbon dioxide is maintained under pressure and the expansion and evaporation of the carbon dioxide passing through the discharge nozzle cools the liquid to such an extent that a portion of it freezes and produces snow-like flakes of carbon dioxide. These flakes of solid carbon dioxide settle in the interior of the container, and sublimate to carbon dioxide gas, thus cooling the interior of the container and the products stored within.

The present system does not present problems of ice surrounding the flakes or particles of carbon dioxide because a large number of small particles presents a very large surface area. Furthermore, if such a situation did occur, the temperature would rise and the temperature sensing device within the container calls for more carbon dioxide liquid to be passed through the nozzle into the container. If this occurred a number of times, there would be a little water vapor left within the interior of the container to form ice.

As stated, the liquid carbon dioxide is stored in the tank at a pressure of 300 lbs. per square inch. When the tank is full, the majority of carbon dioxide in the tank is liquid, but above the liquid gaseous carbon takes up whatever space remains. This pressurized gas provides an excellent media for operating the control system for the flow of liquid carbon dioxide to the discharge nozzle and monitoring the temperature determined by the temperature sensing device within the container. To keep the pressure of the carbon dioxide gas to more easily controllable pressures, at least one pressure-reduction regulator is incorporated to lower the gas pressure for the control system and temperature monitoring system. As the liquid carbon dioxide level in the tank is lowered, more liquid evaporates to gas, maintaining the pressure within the tank until the liquid has all been expended.

The present inventon further provides a self-contained detachable refrigeration unit for a cargo carrying container having at least one porthole therein, the unit comprising: a frame assembly having detachable means for mounting on the container adjacent the porthole, an insulated tank supported within the frame assembly, the tank adapted to contain liquid carbon dioxide, and a control panel mounted on the frame assembly having temperature selective control means; a porthole closure assembly having a portion adapted to detachably fit within and substantially close the porthole of the container, the porthole closure assembly having a venting means, a temperature sensing means, a discharge nozzle directed into the container, and a valve means adapted to control the flow of liquid carbon dioxide to the discharge nozzle; and a flexible connector between the porthole closure assembly and the frame assembly containing a liquid carbon dioxide line between the insulated tank and the discharge nozzle, a temperature transmission line between the temperature sensing means and the temperature selective control means, a control line between the valve means the control panel and a vent line from the venting means to the frame assembly.

In drawings which illustrate embodiments of the invention,

Figure 1:
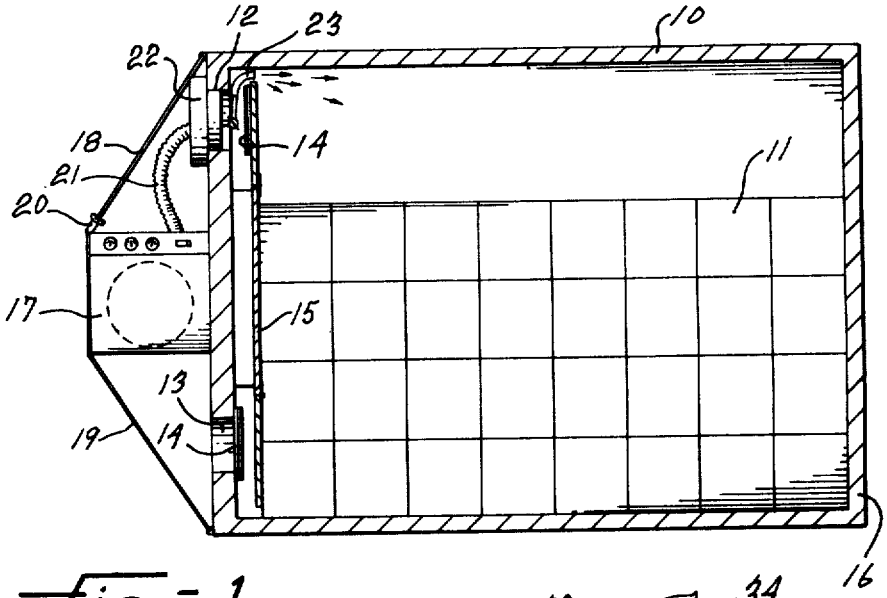
FIG. 1 is a cross-sectional elevational view of a cargo carrying container having a self-contained detachable refrigeration unit of the present inventon mounted at one end thereof and connected to the container by means of a porthole therein.

Referring now to FIG. 1, a cargo carrying container 10 is shown having a stack of food products 11 stored therein. The container 10 is made to I.S.O. standards which set out overall dimensions and details of construction. These standards are accepted internationally and I.S.O. containers are used for carrying cargos throughout the world. At one end of the particular container shown there is an upper porthole 12 and a lower porthole 13. Portholes of this type are common in many containers used in the transportation of refrigerated cargos. If these portholes are not used, they are sealed by porthole closures 14. Such a closure is shown in the lower porthole 13. The porthole closure 14 is connected by spring means (not shown) to a bulkhead 15. In the present embodiment the bulkhead is hinged at the top and bottom so that the porthole closures 14 can be removed by swinging a portion of the bulkhead 15 away. At the other end 16 of the container 10, doors (not shown) are provided to load and unload the food products 11.

The refrigeration system comprises three main components; a frame assembly 17 which is mounted on the end of the container 10 containing the portholes 13 and 14. In the present embodiment the frame assembly is mounted by means of two upper chains 18 and two lower chains 19. The upper chains 18 attach to openings provided in top corner castings which are generally included in the container. In the same way, the lower chains 19 attach to openings provided in lower corner castings of the container. The frame assembly 17 is tightly held to the end of the container 10. In the embodiment shown a tension screw device 20 is attached to the top end of each of the lower chains 19 and each screw device 20 is tightened until the four chains hold the frame assembly 17 tightly to the container. Clamps, cables or other types of locking devices may be used in place of chains to hold the frame assembly 17 to the end of the container.

A flexible connector 21 extends from the top of the frame assembly 17 to a porthole closure assembly 22 which is positioned in the upper porthole 12. The porthole cover 14 is clamped in the open position so that it rests against the bulkhead 15. The discharge nozzle 23 projects inwards from the porthole closure assembly 22 and extends upwards so that the nozzle itself is aimed along the length of the container above the top of the bulkhead 15.

Figure 2:
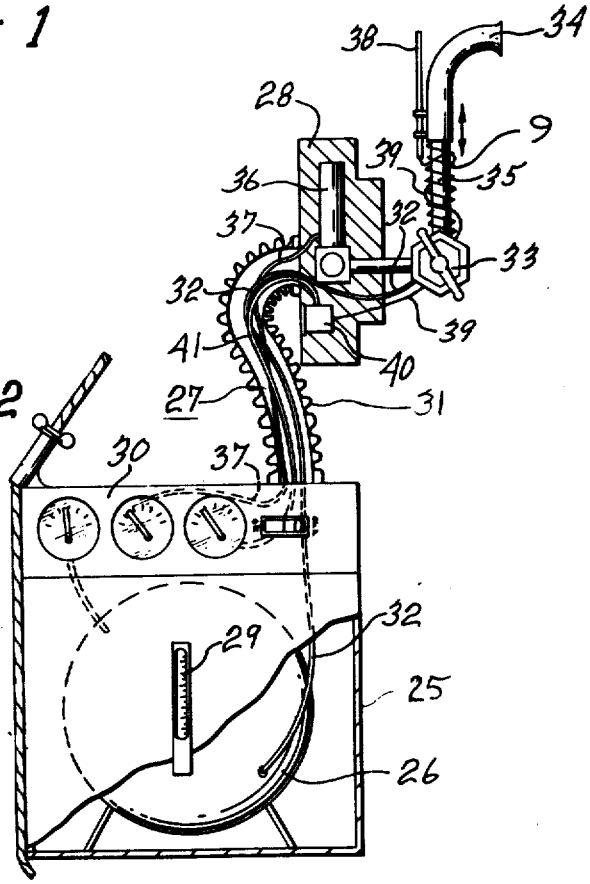
FIG. 2 is a side elevational view of one embodiment of a self-contained detachable refrigeration unit of the present invention showing the frame assembly, the porthole closure assembly and a flexible connector between the two.

The refrigeration unit is shown in more detail in FIG. 2 wherein the frame assembly 25 which is preferably made of welded steel angle sections contains in its lower half a thermally insulated tank 26 for the storage of liquid carbon dioxide and in the upper portion of the frame 25 storage space for the flexible connector 27 and the porthole closure assembly 28 as well as the upper and lower chains for mounting the frame on the container. The tank 26 has a level indicator 29 so that the quantity of liquid carbon dioxide remaining within the tank can be determined.

The upper portion of the frame 25 also contains the control panel 30, whose operation will be further explained by reference to FIGS. 3 and 4. The flexible connector 27 comprises an accordion-like hose 31 which passes from the control panel 30 to the porthole closure assembly 28 where it is open to the interior of the container. This flexible hose 31 provides a vent for the container to prevent a build up of pressure due to the carbon dioxide being passed into the container. The porthole closure assembly 28 acts as a seal within the porthole of the container, and the expelled gas from the interior of the container passes along the flexible hose 31. A liquid carbon dioxide line 32 leads from the bottom of the tank 26, to ensure that liquid is always fed through the line 32 and not gas, through the flexible hose 31 to an on/off liquid valve 33 supported from the porthole closure assembly 28, from whence the liquid passes to a discharge nozzle 34. The discharge nozzle 34 is in the form of an elbow and is mounted telescopically above an extension pipe 35. A coiled spring 9 holds the discharge nozzle 34 in its fully extended position so that when the porthole closure unit 28 is installed within a container porthole, the discharge nozzle 34 rests against the interior top surface of the container. In one embodiment the extension pipe 35 and discharge nozzle 34 are larger in diameter than the liquid carbon dioxide line 32. Thus the liquid carbon dioxide at a pressure of 300 lbs. per square inch expands suddenly through a restricted opening in the on/off valve 33 and this causes snow-like flakes of solid carbon dioxide to form and spray out of the discharge nozzle 34 into the interior of the container.

In another embodiment an expansion orifice is located downstream from the on/off valve 33. The size of the restricted opening in the valve 33 or the expansion orifice downstream of the valve 33 is dependent upon the diameter of the extension pipe 35 downstream of the point of expansion to ensure efficient expansion of the carbon dioxide. To ensure that ice from the water condensation within the container does not form on the discharge nozzle 34, extension pipe 35 and liquid valve 33, insulation is preferably provided surrounding all these components whilst not interfering with the telescopic movement of the nozzle 34. The discharge nozzle 34 together with extension pipe 35 is sometimes known as a "snow horn" because it often has a flared exit and produces snow-like flakes of carbon dioxide.

The on/off valve 33 in the liquid carbon dioxide line 32 is operated by a gas-operated piston actuator 36 within the porthole closure assembly 28. A gas control line 37 leads from the piston actuator 36 through the flexible hose 31 to the control panel 30. A temperature sensing device 38 is mounted on the discharge nozzle 34 thermally isolated therefrom, and measures the temperature in the container. close to the interior top surface. The temperature sensing device 38 has a connecting line 39 to a temperature transmitter 40 within the porthole closure assembly 28. The temperature sensing device 38, connecting line 39 and temperature transmitter 40, form a sealed unit. The temperature transmitter 40 is connected to a temperature transmission line 41 which passes within the flexible hose 31 to the control panel 30. The control panel 30 has a temperature selective control so that the temperature required within the container can be set. A gas carbon dioxide line 42 extends from the top of the tank 26 to the control panel 30 and is used as a media for the control system to maintain the required temperature within the container.

The flexible hose 31 provides a fairly cool ambient temperature for the liquid carbon dioxide line 32, the gas control line 37 and the temperature transmission line 41. Furthermore, the gas passing through the flexible hose 31 tends to be dry as most of the moisture has frozen out of the atmosphere in the container; thus ice does not form around these three lines which is a common problem with cold lines in normal atmosphere conditions.

Figure 3:
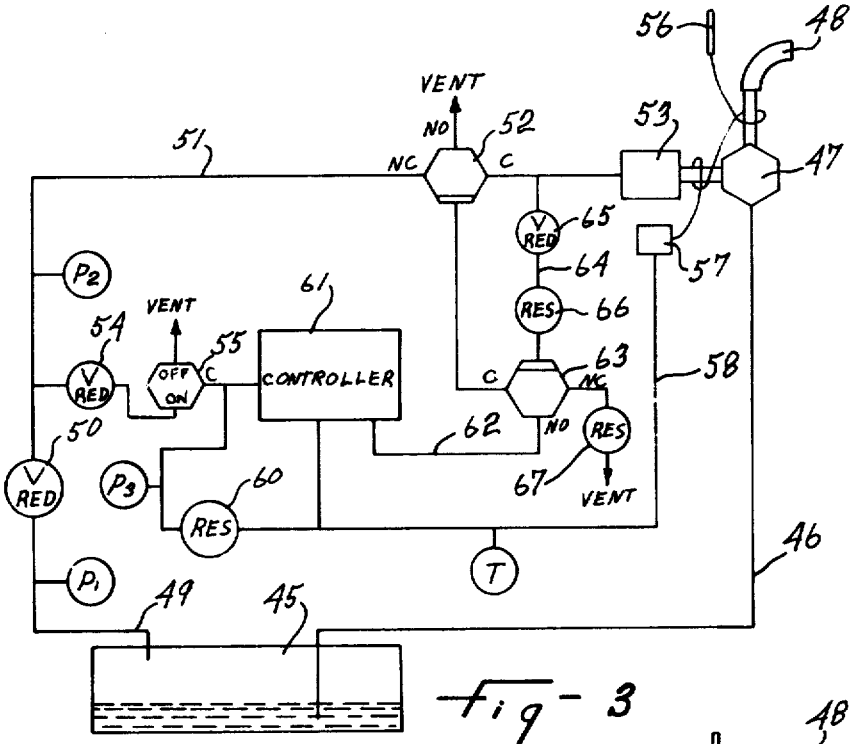
FIG. 3 is a schematic diagram of a suitable control system for a self-contained detachable refrigeration unit of the present invention.

A schematic flow diagram shown in FIG. 3 indicates the carbon dioxide tank 45 having a liquid carbon dioxide line 46 extending from the bottom of the tank 45 to an on/off valve 47. A gaseous carbon dioxide line 49 passes from the top of the tank 45 through a pressure-reducing valve 50 which reduces the pressure from 300 lbs. per square inch to 60 lbs. per square inch. A pressure gauge P1 indicates the pressure within the carbon dioxide tank 45. From the pressure-reducing valve 50 a control line 51 passes through a three-way diaphragm valve 52 to a piston actuator 53. The piston actuator operates the on/off valve 47 for controlling the flow of liquid from the line 46 through valve 47 and expanding through the orifice to the snow horn 48. A pressure gauge P2 indicates the pressure in the control line 51.

In a separate line from the control line 51, another reduction valve 54 reduces the pressure from 60 lbs. per square inch to 20 lbs. per square inch. The line passes through a manual on/off valve 55 which controls the operation of the cooling system. The control valve 55 has a vent to allow the pressure in the control line to drop when the system is turned off. The temperature sensing device 56 feeds a signal to a temperature transmitter 57 which unit then correspondingly varies pressure in the temperature transmission line 58. This system works by varying th escape of gas through the temperature transmitter 57, thus lowering the pressure in the temperature transmission line 58. A pressure gauge is calibrated to read in degrees and thus give an indication of temperature within the container. A restrictor 60 in the system ensures a constant flow of gas to the temperature transmission line 58. The pressure in the line before the restrictor 60 is indicated by a pressure gauge P3. The modulated signal from the temperature transmission line 58 is fed to a controller 61. The controller has a manual adjustable setting which is set to suit the temperature requirements within the container. When the pressure in the temperature transmission line 58 drops below a certain level which is representative of the selected temperature, the controller 61 passes a signal through a normally open three-way diaphragm valve 63 and onwards to control the normally closed three-way diaphragm valve 52 in control line 51, thus activating the piston actuator 53 and opening the on/off valve 47 in the liquid carbon dioxide line 46. When the control line 51 downstream of the diaphragm valve 52 is pressurized, gas is also fed to a line 64 through a pressure-reducing valve 65 which reduces the pressure from 60 lbs. per square inch to 20 lbs. per square inch and an adjustable restrictor 66 to the control of diaphragm valve 63. The restrictor 66 delays the pressure build up on the control of diaphragm valve 63; however, when the activating pressure is reached, valve 63 closes. At this time, although the controller 61 remains open and continues to pass its own demand signal, the signal is interrupted by the switching of the diaphragm valve 63. Simultaneously, the controlling pressure to the control of diagpragm valve 52 now passes to vent via the now open port, N.C. and restrictor 67. Closure of diaphragm valve 52 results, and the piston actuator 53 closes the on/off valve 47. Gas entrapped in line 51 downstream of the diaphragm valve 52 and in line 64 vents through the open port, N.O. in diaphragm valve 52. When pressure in the line 64 is sufficiently reduced, diaphragm valve 63 again switches, and the cycle repeats. The period of cycle and the relative duration of the on and off times are set by adjustments of the restrictors 66 and 67.

In operation the required temperature is set on the dial of the controller 61, and the valve 55 is turned on. If the temperature in the container is above the temperature called for by the controller, it is sensed by the temperature sensing device 56 which through the temperature transmitter 57 signals to the controller 61 to open the diaphragm valve 52 in the control line 51.

Figure 4:
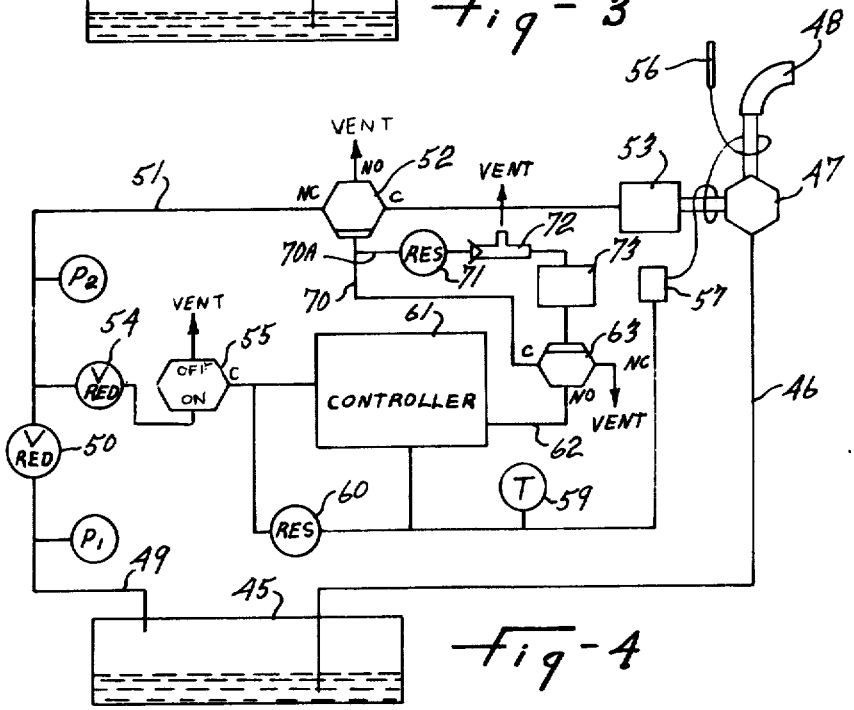
FIG. 4 is a schematic diagram of another control system for a self-contained detachable refrigeration unit.

A further schematic diagram is shown in FIG. 4 wherein a different method is employed of controlling the opening and closing of the on/off diaphragm valve 52 in the control line 51. In this embodiment, a line 70A passes from the line 70 through an adjustable restrictor 71 and a non-return mini-bleed valve 72 which continually permits a small quantity to gas to vent to atmosphere whilst passing a greater flow to a capacity chamber 73, and from there to the control of diaphragm valve 63. In operation this system is similar to the system shown in FIG. 3. The controller 61 passes a signal through the normally open three-way diaphragm valve 63 and onwards to control the normally closed diaphragm valve 52 in control line 51. The adjustable restrictor 71 limits the flow of gas in line 70A and the consequential build up of pressure in the capacity chamber 73 and hence in the control chamber of diaphragm valve 63. The gas flow through restrictor 71 is greater than the escape of gas venting from the mini-bleed valve 72. When sufficient pressure is attained the diaphragm valve 63 switches; at this time, the controller 61 continues to pass its signal along line 62, so the switching of the valve 63 interrupts this signal. The normally open entry port of valve 63 closes, and simultaneously the pressure to the control of diaphragm valve 52 vents to atmosphere through the normally closed port of valve 63.

The gas entrapped in line 70A downstream of the non-return mini-bleed valve 72 is no longer replenished and slowly vents to atmosphere through the mini-bleed valve 72. When the pressure falls below the controlling pressure, the diaphragm valve 63 again switches and the cycle repeats until the signal from the contrller 61 is cut off. The period of each cycle is dependent on the relative size of the opening in the restrictor 71, mini-bleed 72 and the size of the capacity chamber 73.

In one example of the present invention, a 1/16 inch expansion nozzle was fitted to the liquid valve 33 as shown in FIG. 2. This size nozzle allows 1 lb. of liquid carbon dioxide at 300 lbs./sq.in. to pass through in 15 seconds. The control system was arranged so the valve 33 was open for 10 seconds every minute as long as the controller issued a demand signal. The storage tank carried 1000 lbs. of liquid carbon dioxide and there was approximately 100° F temperature differential between the inside and outside of the container. The container had a 40 B.T.U. nominal heat loss per hour per degree Fahrenheit difference. The carbon dioxide in the storage tank lasted for a duration of 36 hours before requiring replenishing.

It will be apparent to those skilled in the art that various changes can be made in this specific control system without departing from the scope of the present invention. For instance, a visual or sonic sounding alarm could be included when the level of the carbon dioxide liquid in the tank dropped below a certain level. Such a system would indicate that the unit would have to be refilled or changed on the container. These units are kept at convenient locations with each tank full of liquid carbon dioxide, and the porthole closure assembly and flexible connector stored within the frame assembly. When a unit mounted on a container is nearly empty, it is refilled or in some cases replaced with a fully charged unit. The on/off switch 55 shown in FIGS. 3 and 4 is in the off position when the unit is not in use so that the carbon dioxide would not be discharged through the nozzle 48. There is always some venting from the liquid carbon dioxide in the tank, but the loss would be nothing more than the normal loss when storing liquid carbon dioxide at this temperature.

The embodiments of the invention in which an exclusive property of privilege is claimed are defined as follows:

1. A self-contained detachable refrigeration unit operably connectable to a cargo carrying container having at least one porthole therein, said detachable refrigeration unit comprising:

a frame assembly having detachable means for mounting on the container adjacent the porthole, an insulated tank supported within said frame assembly, said tank adapted to contain liquid carbon dioxide, and a control panel mounted on said frame assembly having temperature selective control means;

a porthole closure assembly having a portion adapted to detachably fit and substantially close the porthole of the container, said porthole closure assembly comprising integrally therewith a venting means, a temperature sensing means, a discharge nozzle directed into the container, and a valve means adapted to control the flow of liquid carbon dioxide to said discharge nozzle;

and a flexible connector between said porthole closure assembly and said frame assembly containing a liquid carbon dioxide line providing fluid communication between said insulated tank and said discharge nozzle,, a temperature transmission line providing communication between said temperature sensing means and said temperature selective control means, and a control line providing communication between said valve means and said control panel, and a vent line from said venting means to said frame assembly.

2. The refrigeration unit according to claim 1 wherein said discharge nozzle is in the shape of an elbow and is in a spring-loaded telescopic relation with an extension pipe.

3. The refrigeration unit according to claim 1 wherein said valve means includes a piston actuator adapted to open and close a valve in said liquid carbon dioxide line and said control line is a pressurized gas line.

4. The refrigeration unit according to claim 3 including a gaseous carbon dioxide line from the top of said insulated tank to said control panel, a first pressure-reduction regulator mounted in said gaseous line supplying gas to said control line, a second pressure-reduction regulator in line with said first pressure-reduction regulator supplying gas to said temperature transmission line, and a control line valve means in the control line to said piston actuator operated in conjunction with a signal from said temperature selective control means.

5. The refrigeration unit according to claim 4 wherein said gaseous carbon dioxide line from the top of said insulated tank is approximately 300 lbs. per square inch; said first pressure-reduction regulator reduces the pressure on said control line to approximately 60 lbs. per square inch, and said second pressure-reduction regulator reduces the pressure in said temperature transmission line to approximately 20 lbs. per square inch.

6. The refrigeration unit according to claim 1 wherein said flexible connector comprises a hose which forms said vent line said liquid carbon dioxide line, said temperature transmission line and said control line passing within said hose.

7. The refrigeration unit according to claim 1 wherein said porthole closure assembly and said flexible connector have a storage space in the frame assembly.

8. The refrigeration unit according to claim 1 wherein said detachable means for mounting said frame assembly includes a pair of upper chains and a pair of lower chains with screw tensioners, and both upper and lower pairs of chains have a storage space in said frame assembly.

* * * * *